US006601646B2

(12) United States Patent
Streich et al.

(10) Patent No.: US 6,601,646 B2
(45) Date of Patent: Aug. 5, 2003

(54) APPARATUS AND METHOD FOR SEQUENTIALLY PACKING AN INTERVAL OF A WELLBORE

(75) Inventors: Steven G. Streich, Duncan, OK (US); Tommy F. Grigsby, Houma, LA (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/894,559

(22) Filed: Jun. 28, 2001

(65) Prior Publication Data

US 2003/0000702 A1 Jan. 2, 2003

(51) Int. Cl.[7] ..... E21B 43/04
(52) U.S. Cl. ..... 166/278; 166/51
(58) Field of Search ..... 166/278, 51, 308, 166/56, 157, 177.5

(56) References Cited

U.S. PATENT DOCUMENTS

| | | | |
|---|---|---|---|
| 2,342,913 A | 2/1944 | Williams et al. | |
| 2,344,909 A | 3/1944 | Williams et al. | |
| 4,945,991 A | 8/1990 | Jones | 166/278 |

(List continued on next page.)

FOREIGN PATENT DOCUMENTS

| | | | |
|---|---|---|---|
| EP | 1 132 571 | 9/2001 | E21B/43/267 |
| WO | WO 99/12630 | 3/1999 | B01D/29/15 |
| WO | WO 00/61913 | 10/2000 | E21B/43/04 |
| WO | WO 01/14691 | 3/2001 | E21B/43/08 |
| WO | WO 01/44619 | 6/2001 | E21B/43/04 |
| WO | WO 02/10554 | 2/2002 | E21B/43/26 |

OTHER PUBLICATIONS

"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.

"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.

"Caps$^{sm}$ Concentric Annular Packaging Service for Sand Control," Halliburton Energy Services, Inc., Aug., 2000.

"Caps$^{sm}$ Sand Control Service for Horizontal Completions Improves Grave Pack Reliability and Increases Production Potential from Horizontal Completions," Halliburton Energy Services, Inc., Aug., 2000.

"Frac Pack Technology Still Evolving," Charles D. Ebinger of Ely & Associates Inc.; Oil & Gas Journal, Oct. 23, 1995.

"Mechanical Fluid–Loss Control Systems Used During Sand Control Operations," H.L. Restarick of Otis Engineering Corp., 1992.

"Sand Control Screens,", Halliburton Energy Services, 1994.

*Primary Examiner*—David Bagnell
*Assistant Examiner*—Jennifer R. Dougherty
(74) *Attorney, Agent, or Firm*—Lawrence R. Youst

(57) ABSTRACT

An apparatus (38) and method for sequentially packing an interval of a wellbore (32) is disclosed. The apparatus (38) comprises a cross-over assembly (40) having first and second exit ports (58, 62). The cross-over assembly (40) has a fracturing configuration wherein the first exit port (58) is open and the second exit port (62) is closed and a gravel packing configuration wherein the first exit port (58) is closed and the second exit port (62) is open. The apparatus (38) also includes a gravel packing assembly (42) that has an inlet that receives the gravel packing slurry from the second exit port (62) and a plurality of outlets (72) that allow for the delivery the gravel slurry to a plurality of locations along the length of a sand control screen (52).

44 Claims, 8 Drawing Sheets

U.S. PATENT DOCUMENTS

| | | | | | |
|---|---|---|---|---|---|
| 5,082,052 | A | | 1/1992 | Jones et al. | 166/51 |
| 5,113,935 | A | | 5/1992 | Jones et al. | 166/51 |
| 5,161,613 | A | | 11/1992 | Jones | 166/242 |
| 5,161,618 | A | | 11/1992 | Jones et al. | 166/308 |
| 5,333,688 | A | | 8/1994 | Jones et al. | 166/278 |
| 5,355,956 | A | | 10/1994 | Restarick | 166/296 |
| 5,390,966 | A | | 2/1995 | Cox et al. | 285/137.1 |
| 5,419,394 | A | | 5/1995 | Jones | 166/51 |
| 5,443,117 | A | | 8/1995 | Ross | 166/51 |
| 5,476,143 | A | | 12/1995 | Sparlin et al. | 166/233 |
| 5,515,915 | A | | 5/1996 | Jones et al. | 166/51 |
| 5,588,487 | A | | 12/1996 | Bryant | 166/51 |
| 5,597,040 | A | * | 1/1997 | Stout et al. | 166/51 |
| 5,636,691 | A | | 6/1997 | Hendrickson et al. | 166/278 |
| 5,755,286 | A | | 5/1998 | Ebinger | 166/281 |
| 5,842,516 | A | | 12/1998 | Jones | 166/56 |
| 5,848,645 | A | | 12/1998 | Jones | 166/280 |
| 5,868,200 | A | | 2/1999 | Bryant et al. | 166/51 |
| 5,890,533 | A | | 4/1999 | Jones | 166/51 |
| 5,921,318 | A | | 7/1999 | Ross | 166/250.17 |
| 5,934,376 | A | | 8/1999 | Nguyen et al. | 166/278 |
| 5,964,296 | A | * | 10/1999 | Ross | 166/373 |
| 6,003,600 | A | | 12/1999 | Nguyen et al. | 166/281 |
| 6,047,773 | A | | 4/2000 | Zeltmann et al. | 166/281 |
| 6,059,032 | A | | 5/2000 | Jones | 166/278 |
| 6,065,535 | A | * | 5/2000 | Ross | 166/51 |
| 6,116,343 | A | | 9/2000 | Van Petegem et al. | 166/297 |
| 6,125,933 | A | | 10/2000 | Ross | 166/250.01 |
| 6,220,345 | B1 | | 4/2001 | Jones et al. | 166/51 |
| 6,227,303 | B1 | | 5/2001 | Jones | 166/378 |
| 6,230,803 | B1 | | 5/2001 | Morton et al. | 166/278 |
| 6,343,651 | B1 | | 2/2002 | Bixenman | 166/278 |

* cited by examiner

APPARATUS AND METHOD FOR SEQUENTIALLY PACKING AN INTERVAL OF A WELLBORE

TECHNICAL FIELD OF THE INVENTION

This invention relates in general to the treatment of a production interval of a wellbore to stimulate hydrocarbon production and prevent the production of fine particulate materials and, in particular, to an apparatus and method for sequentially fracturing the production interval then substantially completely gravel packing the wellbore adjacent to the production interval.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulates. For example, the particulates cause abrasive wear to components within the well, such as tubing, pumps and valves. In addition, the particulates may partially or fully clog the well creating the need for an expensive workover. Also, if the particulate matter is produced to the surface, it must be removed from the hydrocarbon fluids using surface processing equipment.

One method for preventing the production of such particulate material to the surface is gravel packing the well adjacent the unconsolidated or loosely consolidated production interval. In a typical gravel pack completion, a sand control screen is lowered into the wellbore on a workstring to a position proximate the desired production interval. A fluid slurry including a liquid carrier and a relatively coarse particulate material, which is typically sized and graded and which is referred to herein as gravel, is then pumped down the workstring and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

It is sometimes desirable to perform a formation fracturing and propping operation prior to or simultaneously with the gravel packing operation. Hydraulic fracturing of a hydrocarbon formation is sometimes necessary to increase the permeability of the production interval adjacent the wellbore. According to conventional practice, a fracture fluid such as water, oil, oil/water emulsion, gelled water or gelled oil is pumped down the work string with sufficient pressure to open multiple fractures in the production interval. The fracture fluid may carry a suitable propping agent, such as sand or gravel, which is referred to herein as a proppant, into the fractures for the purpose of holding the fractures open following the fracturing operation.

The fracture fluid must be forced into the formation at a flow rate great enough to fracture the formation allowing the entrained proppant to enter the fractures and prop the formation structures apart, producing channels which will create highly conductive paths reaching out into the production interval, and thereby increasing the reservoir permeability in the fracture region. As such, the success of the fracture operation is dependent upon the ability to inject large volumes of hydraulic fracture fluid into the surrounding formation at a high pressure and at a high flow rate.

For most hydrocarbon formations, a successful fracture and propping operation will require injection flow rates that are much higher than those required for gravel packing. For example, in typical gravel packing, a single pump capable of delivering one to ten barrels per minute may be sufficient. On the other hand, for a successful fracturing operation, three or four large capacity pumps may be required in order to pump at rates higher than the formation fracture gradient which may range up to 60 barrels per minute or more.

It has been found that it is difficult to achieve a complete gravel pack of the desired production interval as part of or following a fracturing operation and particularly in long or inclined/horizontal production intervals. These incomplete packs are commonly a result of the liquid carrier entering the permeable portions of the production interval causing the gravel to form a sand bridge in the annulus. Thereafter, the sand bridge prevents the gravel pack slurry from flowing to the remainder of the annulus which, in turn, prevents the placement of sufficient gravel in the remainder of the annulus.

Therefore a need has arisen for an apparatus and method that are capable of fracturing a production interval. A need has also arisen for such an apparatus and method that produce a complete gravel pack of the wellbore adjacent to the production interval following the fracturing of the production interval. Further, a need has arisen for an apparatus and method that are capable of sequentially stimulating of the production interval then gravel packing the production interval to prevent the production of fine particulate materials when production commences.

SUMMARY OF THE INVENTION

The present invention disclosed herein comprises an apparatus and method that are capable of fracturing a production interval and producing a complete gravel pack of the wellbore adjacent to the production interval following the fracturing operation. Specifically, the apparatus and method of the present invention are used to sequentially pack the interval of a wellbore by first delivering a large volume of fracture fluids at a high flow rate and at a pressure above the fracture pressure of the formation then delivering a gravel packing slurry at a lower flow rate. The gravel packing slurry is delivered through a gravel packing apparatus which allows for the complete gravel packing of the interval.

Even though the present invention utilizes a gravel packing assembly to deliver the gravel packing slurry, the high flow rate fracture fluid is not delivered through the gravel packing assembly as prior art attempts to deliver both the fracture fluids at the high flow rates then the gravel packing slurry at the lower flow rate through a gravel packing assembly have not been successful and have resulted in low quality fractures of the formation, incomplete gravel packs or both. Instead, the present invention allows high volume fluid delivery of fracture fluids directly into the wellbore but also allows lower volume delivery of the gravel packing slurry into the wellbore via a gravel packing assembly.

The apparatus for sequentially packing an interval of a wellbore comprises a cross-over assembly partially disposed within a cross-over packer assembly. The cross-over assembly has a set of fracture fluid exit ports and a set of gravel packing exit ports positioned on one side of the packer and a return port positioned on the other side of the packer. The cross-over assembly has a fracturing configuration wherein the fracture fluid exit ports are open, the gravel packing exit ports are closed and the return port either open or closed depending upon the service tool setup. In the fracturing configuration, fracture fluids are delivered through the cross-over assembly via the fracture fluid exit ports directly into the wellbore such that the formation can be fractured. The return ports may be opened to allow for surface pressure monitoring of the annulus between the casing and the work string.

The cross-over assembly also has a gravel packing configuration wherein the fracture fluid exit ports are closed, the gravel packing slurry exit ports are open and the return port is open. In the gravel packing configuration, the gravel slurry is delivered through the gravel packing exit ports into a gravel packing assembly. The gravel packing assembly, which is positioned adjacent to a sand control screen, has a plurality of outlets that are located proximate the sand control screen and that extend along the gravel packing assembly substantially the length of the sand control screen such that the gravel packing slurry is delivered to multiple locations within the wellbore bypassing any sand bridge formation. In the gravel packing configuration, a wash pipe may be disposed within the sand control screen to take returns. The wash pipe is in fluid communication with the return port when the cross-over assembly is in the gravel packing configuration.

Operation of the cross-over assembly from the fracturing configuration to the gravel packing configuration may be achieved in a variety of ways such as through the use of a sliding sleeve, the operation of valves and the like. Likewise, the gravel packing assembly may have a variety of configuration so long as it is capable of overcoming the formation of sand bridges. For example, the distribution of the gravel slurry to multiple location along the length of the sand control screen may be accomplished using a gravel packing assembly having a plurality of conduits having numerous outlets, using a gravel packing assembly having an axially extending slurry passageway and an axially extending production pathway between inner and outer tubulars or using other similar gravel packing assemblies.

In the method of the present invention, sequential fracturing and gravel packing an interval of a wellbore is achieved by traversing a formation with the wellbore, locating a sand control screen within the wellbore proximate the formation, disposing a sequential packing apparatus proximate the sand control screen, positioning the sequential packing in a first position wherein a first exit port is open and a second exit port is closed, pumping a fluid slurry containing propping agents into the sequential packing apparatus such that the fluid slurry containing propping agents exits through the first port at a pressure above the fracture pressure of the formation, operating the sequential packing apparatus from the first position to the second position wherein the first exit port is closed and the second exit port is open, pumping a fluid slurry containing gravel into the sequential packing apparatus such that the fluid slurry containing gravel exits through the second port and discharging the fluid slurry containing gravel into a gravel packing assembly.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
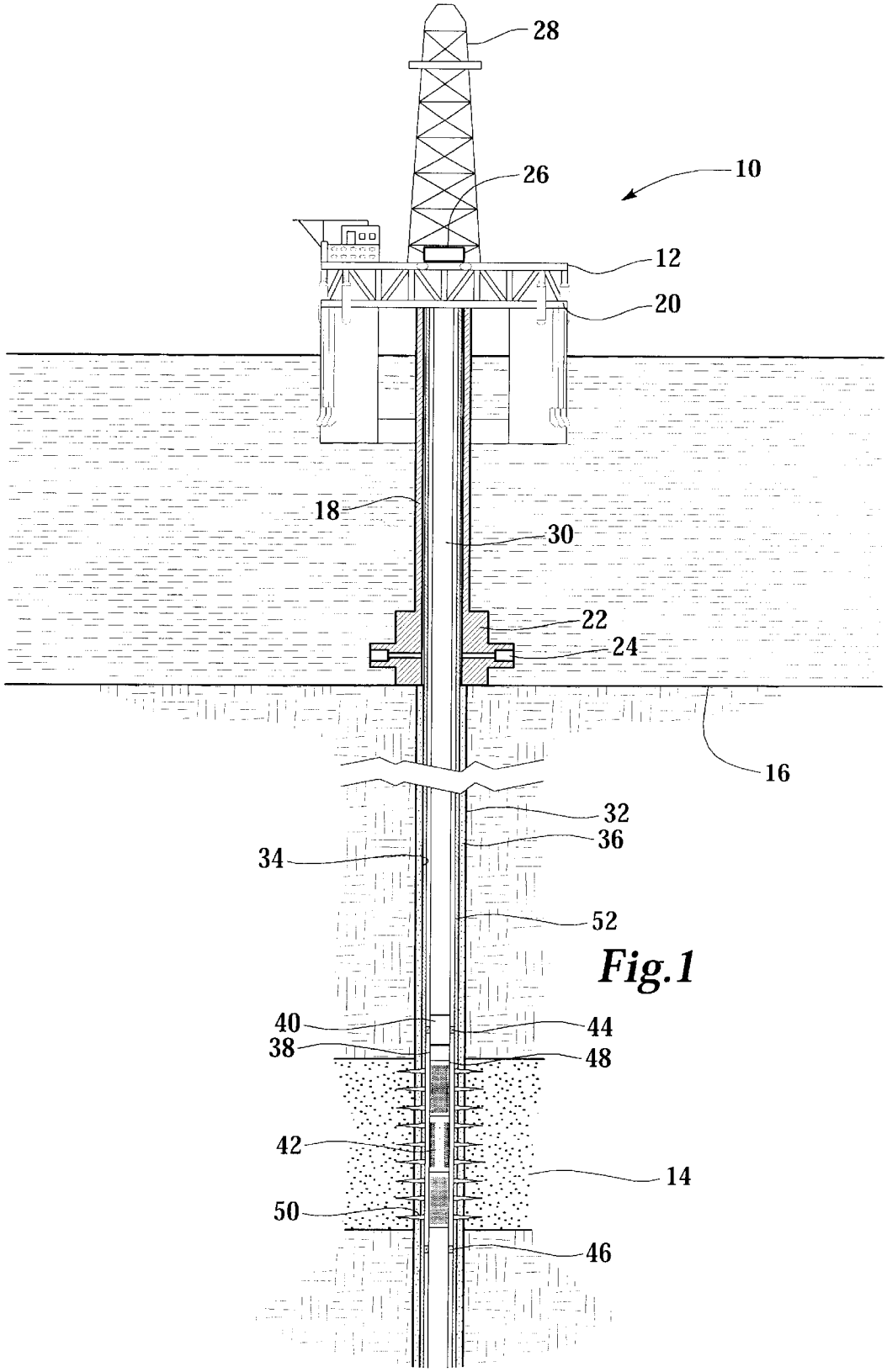
FIG. 1 is a schematic illustration of an offshore oil and gas platform operating an apparatus for sequentially packing an interval of a wellbore of the present invention.

Referring initially to FIG. 1, an apparatus for sequentially packing an interval of a wellbore operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools including apparatus 38 for sequentially packing an interval of wellbore 32 adjacent to formation 14. Apparatus 38 includes a cross-over assembly 40 and a gravel packing assembly 42 which is used to gravel pack annulus 48 between packers 44, 46. When it is desired to treat formation 14, work string 30 is lowered through casing 34 until apparatus 38 is positioned adjacent to formation 14 including perforations 50. Thereafter, treatment fluids are pumped down work string 30 through apparatus 38 to stimulate formation 14 and gravel pack annulus 48.

Even though FIG. 1 depicts a vertical well, it should be noted by one skilled in the art that the apparatus for sequentially packing an interval of a wellbore of the present invention is equally well-suited for use in deviated wells, inclined wells or horizontal wells. Also, even though FIG. 1 depicts an offshore operation, it should be noted by one skilled in the art that the apparatus for sequentially packing an interval of a wellbore of the present invention is equally well-suited for use in onshore operations.

Figure 2:
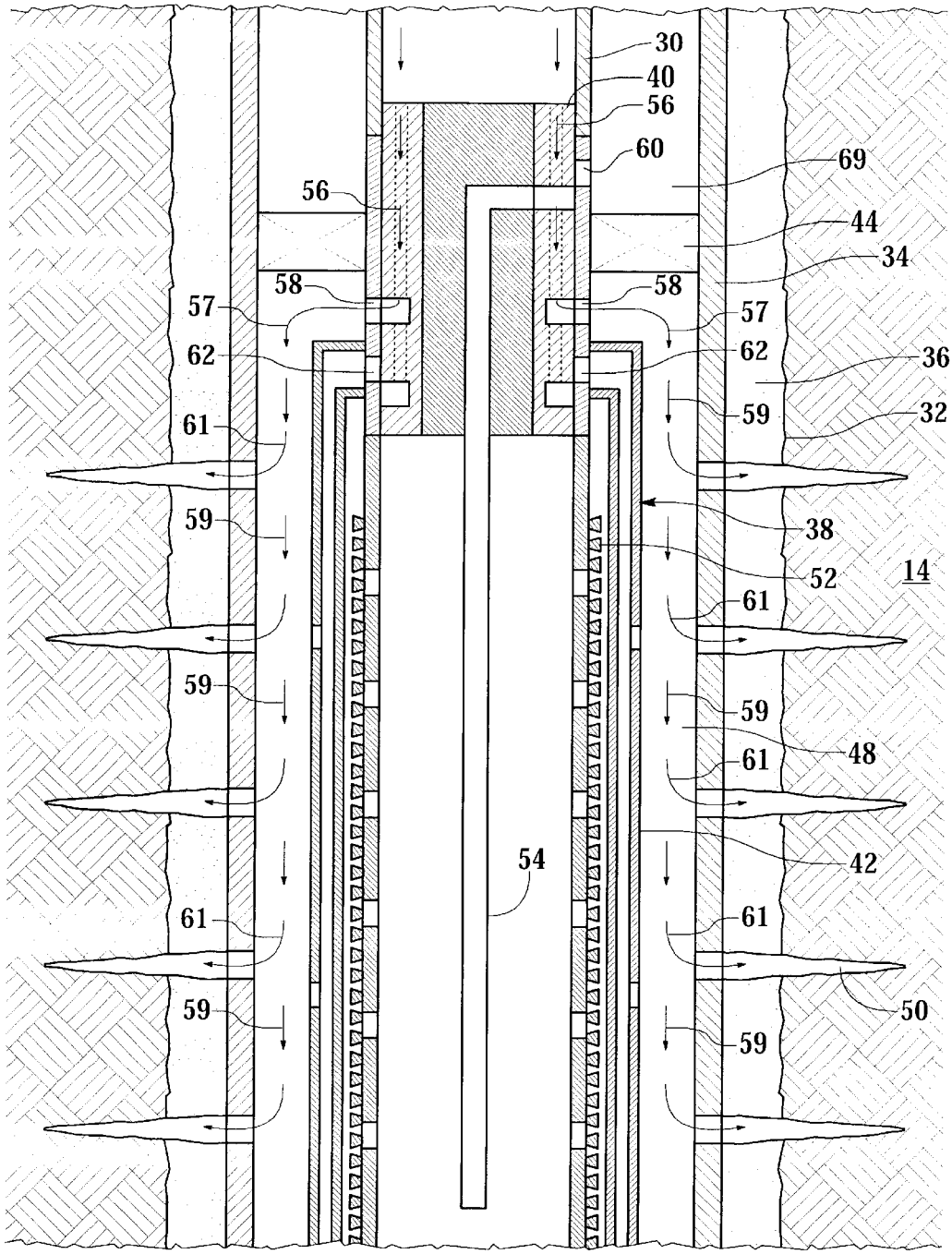
FIG. 2 is a half sectional view of an apparatus for sequentially packing an interval of a wellbore of the present invention in its fracturing position.

Referring now to FIG. 2, therein is depicted a more detailed illustration of apparatus 38. As illustrated, apparatus 38 includes cross-over assembly 40, a screen assembly 52, gravel packing assembly 42 and a wash pipe 54. Apparatus 38 is connected to work string 30 extending from the surface, which lowers apparatus 38 into wellbore 32 until screen assembly 52 is properly positioned adjacent formation 14.

To begin the completion process, the interval adjacent formation 14 is isolated. Packer 44 seals the upper end of the production interval and packer 46 (see FIG. 1) seals the lower end of the production interval. Cross-over assembly 40 is located above screen assembly 52 and partially above and partially below packer 44. During the fracture treatment, the fracture fluid is pumped down work string 30, into apparatus 38 and through cross-over assembly 40 along the path indicated by arrows 56.

As illustrated in FIG. 2, apparatus 38 is in its fracture position. In the fracture position, the top of wash pipe 54 is closed at port 60 so fluids cannot return to the surface. During the fracturing operation, the fracture fluid passes through cross-over ports 58 below packer 44, as indicated by arrows 57, flowing down annulus 48 as indicated by arrows 59. The fracture fluid is then forced at a high flow rate through perforations 50 and into formation 14 as indicated by arrows 61. The fracture fluid tends to fracture or part the rock to form open void spaces in formation 14. As more rock is fractured, the void space surface area increases in formation 14. The fracture operation continues until an equilibrium is reached where the amount of fluid introduced into formation 14 approximates the amount of fluid leaking off into the rock, whereby the fracture stops propagating. The proppant material in the fracture fluid maintains the voids in an open position for production.

Figure 3:
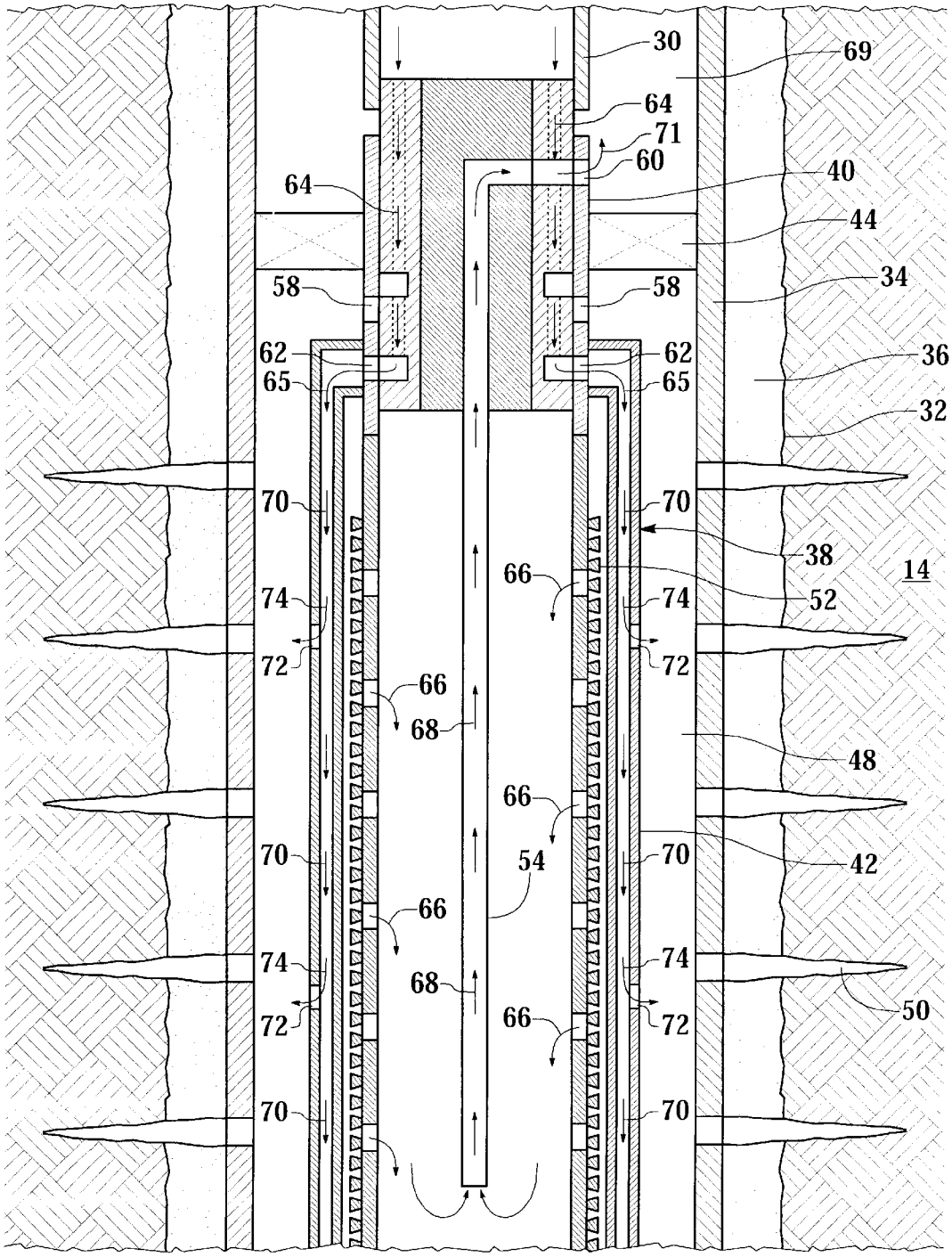
FIG. 3 is a half sectional view of an apparatus for sequentially packing an interval of a wellbore of the present invention in its gravel packing position.

Once the fracture treatment is complete, the gravel packing operation commences. During gravel packing, the objective is to uniformly fill annulus 48 with gravel along the entire production interval. Prior to introducing the gravel pack slurry, apparatus 38 is placed in the gravel pack position, as best seen in FIG. 3. In its gravel packing position, port 60 of apparatus 38 is open to wash pipe 54, cross-over ports 58 are closed and cross-over ports 62 are open. The gravel pack slurry is then pumped down work string 30 into cross-over assembly 40 along the path indicated by arrows 64. The slurry exits cross-over assembly 40 through cross-over ports 62 as indicated by arrows 65 before entering gravel packing assembly 42. The slurry then travels down gravel packing assembly 42 as indicated by arrows 70 before being discharged through ports 72 into annulus 48 as indicated by arrow 74. Some of the carrier fluid in the slurry leaks off through perforations 50 into formation 14 while the remainder of the fluid passes through screen 52 that is sized to prevent the gravel in the slurry from flowing therethrough. The fluid flowing back through screen 52, depicted as arrows 66, enters the inner annular area formed between screen 52 and wash pipe 54, and flows through the lower end of wash pipe 54 up the path indicated by arrows 68. The return fluids flow out through cross-over port 60 into annulus 69 above packer 44 as indicated by arrow 71, then back to the surface.

Preferably the gravel in the slurry is very uniform in size and has a very high permeability. As the carrier fluid leaks off through the screen 52, the gravel drops out of the slurry and builds up from the formation fractures back toward wellbore 32, filling perforations 50 and annulus 48 around screen 52 to form a gravel pack. The size of the gravel in the gravel pack is selected to prevent formation fines and sand from flowing into wellbore 32 with the produced fluids.

It has been found that a high leak off of fluid through perforations 50 into formation 14 may occur during a typically gravel packing operation, particularly following a fracture operation in a highly deviated or long production interval. More specifically when leak off into formation 14 occurs, the gravel tends to deposit around the adjacent perforations 50 thus forming a node. The node is a build up of gravel that grows radially and may grow so large that it forms a bridge and completely blocks annulus 48. The resulting incomplete annular pack has sections of screen 52 that remain uncovered, which can lead to formation sand production, screen erosion and eventual failure of the completion. This problem is overcome in the present invention by injecting the gravel slurry into gravel packing assembly 42. To prevent the problems caused by sand bridge formation, as explained above, the gravel slurry travels within gravel packing assembly 42 as indicated by arrows 70 with portions of the gravel slurry exiting gravel packing assembly 42 through exit ports 72 along the length of gravel packing assembly 42, which extends along the length of sand control screen 52, as indicated by arrows 74.

It should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. It should be noted, however, that the apparatus for sequentially packing an interval of a wellbore is not limited to such orientation as it is equally-well suited for use in inclined and horizontal orientations.

Figure 4:
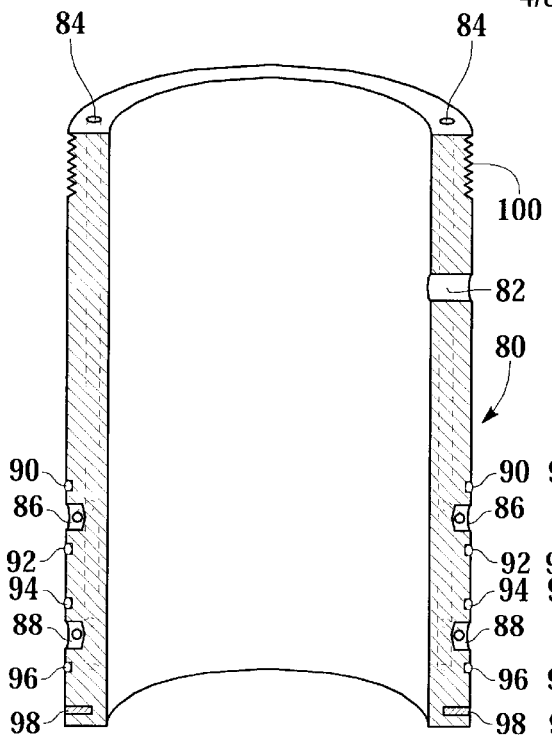
FIG. 4 is an isometric view of an internal sleeve of an apparatus for sequentially packing an interval of a wellbore of the present invention.

Referring next to FIG. 4, therein is depicted a sleeve of cross-over assembly 40 that is generally designated 80. Sleeve 80 is positioned within the outer housing of cross-over assembly 40 and is axially slidable therein. Sleeve 80 includes a return port 82 that extends through the side wall of sleeve 80. Return port 82 is coupled to the upper end of wash pipe 54 as best seen in FIGS. 2 and 3. Sleeve 80 also includes a plurality of fluid conduits that receive the fluid pumped down work string 30. In the illustrated embodiment, two such fluid conduits are depicted and are designated 84. Fluid conduits 84 are in fluid communication with a first set of ports 86 used to deliver the fracturing fluid and a second set of ports 88 used to deliver the gravel pack slurry. Ports 86 and 88 selectively discharge the fluids from conduits 84. Disposed on either side of ports 86 is a pair of o-rings 90, 92 that provide a seal between sleeve 80 and the outer housing of cross-over assembly 40. Likewise, on either side of ports 88 there is a pair of o-rings 94, 96 that also provide such a seal. Sleeve 80 includes a plurality of shear pins, two of which are shown and are designated 98. Shear pins 98 are used to selectively prevent the axial movement of sleeve 80 relative to the outer housing of cross-over assembly 40. Sleeve 80 has a plurality of threads 100 at its upper end that may be threadedly coupled to work string 30.

Referring collectively to FIGS. 2, 3 and 4, when apparatus 38 is in its fracture position, sleeve 80 is secured within the outer housing of cross-over assembly 40 by shear pins 98 such that ports 86 of sleeve 80 are aligned with ports 58 in the outer housing of cross-over assembly 40. In this position, port 82 of sleeve 80 is not aligned with port 60 of the outer housing of cross-over assembly 40 and ports 88 of sleeve 80 are not aligned with ports 62 in the outer housing of cross-over assembly 40. Thus, when the fracture fluid is pumped down work string 30, the slurry enters conduits 84 of sleeve 80 and exits sleeve 80 through ports 86 which are aligned with ports 58 such that the fracture fluids enter annulus 48 and formation 14 as indicated by arrows 57, 59 and 61.

Figure 5:
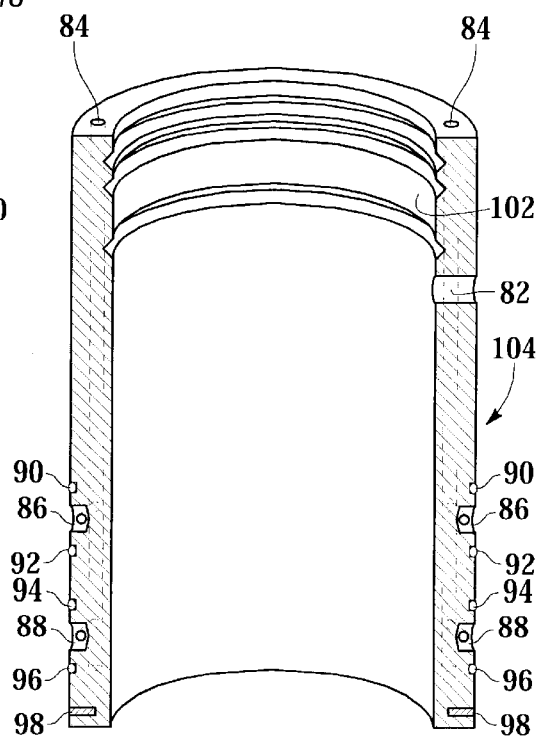
FIG. 5 is an isometric view of an internal sleeve having an inner profile of an apparatus for sequentially packing an interval of a wellbore of the present invention.

Once the fracture operation is complete, apparatus 38 may be shifted from its fracturing position to its gravel packing position by upwardly shifting sleeve 80 such that port 82 of sleeve 80 becomes aligned with port 60 of the outer housing of cross-over assembly 40, ports 88 of sleeve 80 become aligned with ports 62 of the outer housing of cross-over assembly 40 and such that ports 86 of sleeve 80 are no longer aligned with ports 58 of the outer housing of cross-over assembly 40, as best seen in FIG. 3. In the illustrated embodiment, this upward shifting of sleeve 80 is achieved by pulling upwardly on work string 30 with sufficient force to shear pins 98 allowing sleeve 80 to slide axially relative to the outer housing of cross-over assembly 40. Alternatively, as depicted in FIG. 5, a wireline pulling tool may be landed and locked within a profile 102 of sleeve 104. The pulling tool is then used to upwardly urge sleeve 104 causing shear pins 98 to shear and allowing sleeve 104 to shift from the fracturing position to the gravel packing position of apparatus 38.

Referring again to FIGS. 3 and 4, once apparatus 38 has been shifted to its gravel packing position, the gravel packing slurry may be injected down work string 30 such that it enters conduits 84 and exits sleeve 80 via ports 88. Upon exiting ports 88, the gravel slurry passes through ports 62 and enters gravel packing assembly 42 as indicated by arrows 65. Once in gravel packing assembly 42, the gravel slurry travels downwardly as indicated by arrows 70 exiting through ports 72 as indicated by arrows 74. As described above, the gravel in the gravel packing slurry is deposited in annulus 48 between casing 34 and screen 52. Some of the fluid from the gravel packing slurry enters screen 52 as indicated by arrows 66 and travels up through wash pipe 54 as indicated by arrows 68 and into annulus 69 between work string 30 and casing 34 above packer 44.

Even though FIG. 4 has depicted sleeve 80 as having two sets of ports 86, 88 for delivering fluid, it should be understood by those skilled in the art that sleeve 80 could alternatively have a single set of ports that is first aligned with a set of fracture fluid discharge ports in the outer housing of the cross-over assembly then shifted to be aligned with a set of gravel packing slurry discharge ports of the outer housing of the cross-over assembly for gravel packing operations. Likewise, even though FIG. 4 has depicted ports 86 and 88 being in fluid communication with one another via conduits 84, it should be understood by those skilled in the art that ports 86 and 88 could alternatively be isolated from one another by receiving fluids from different conduits.

Also, even though FIGS. 2, 3 and 4 have depicted sleeve 80 as being shifted upwardly to operate cross-over assembly 40 from its fracturing configuration to its gravel packing configuration, it should be understood by those skilled in the art that a sleeve could alternatively be shifted downwardly or rotated to operate a cross-over assembly from its fracturing configuration to its gravel packing configuration. Further, even though FIGS. 2, 3 and 4 have depicted the fracture fluid discharge ports as being above the gravel pack slurry discharge ports, it should be understood by those skilled in the art that the position of these ports could alternatively be reversed.

Figure 7:
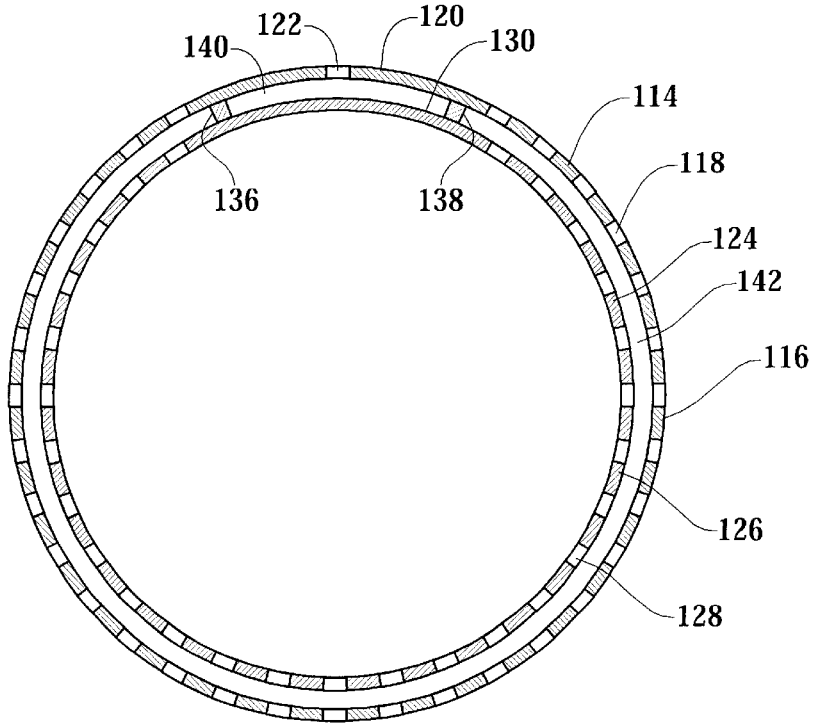
FIG. 7 is a cross sectional view of the gravel packing apparatus taken along line 7—7 of FIG. 6.
Figure 6:
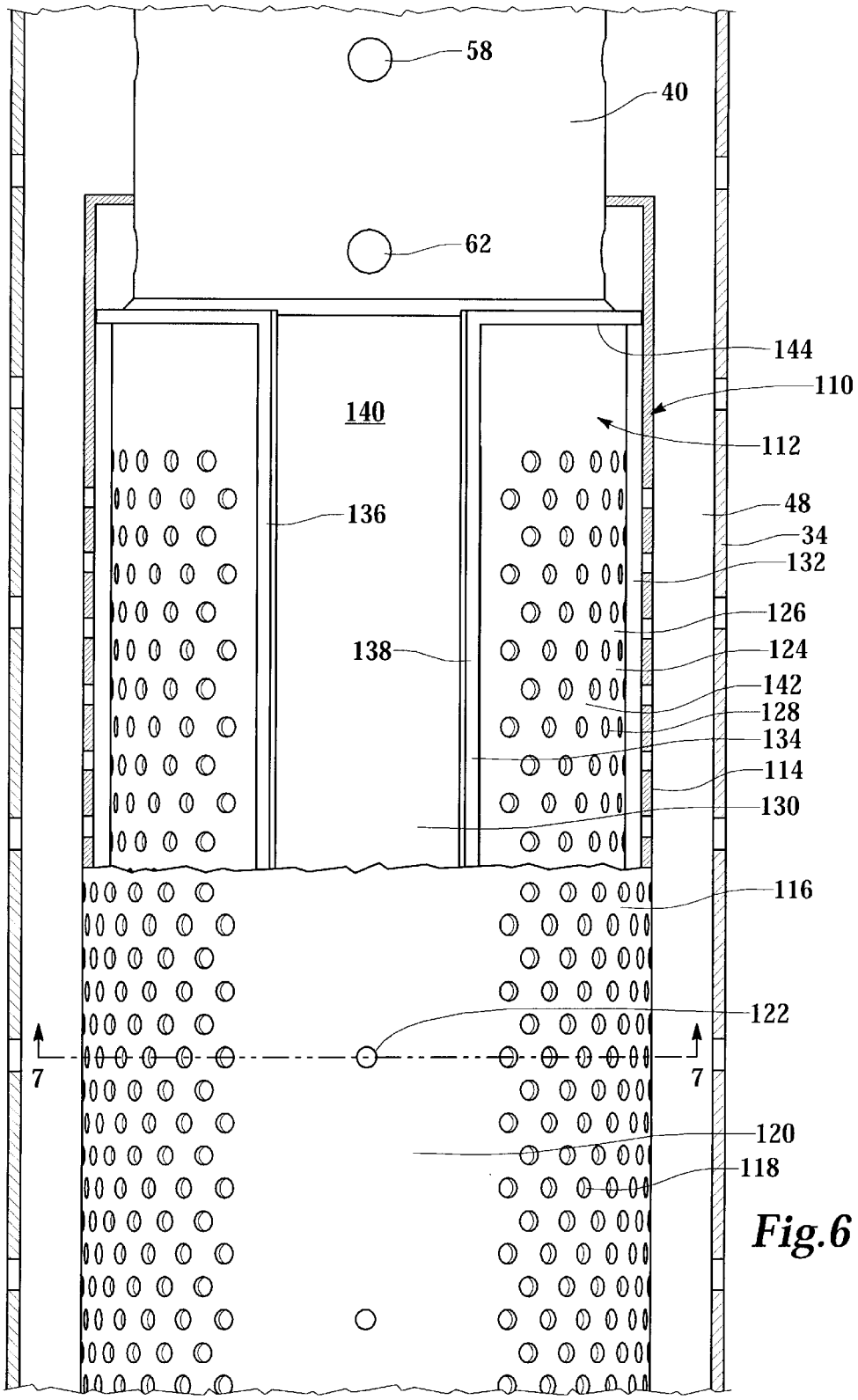
FIG. 6 is a partial cutaway view of a gravel packing apparatus of an apparatus for sequentially packing an interval of a wellbore of the present invention.

Referring now to FIG. 6, therein is depicted a partial cut away view of an apparatus for sequential packing an interval of a wellbore of the present invention that is generally designated 110. In the illustrated embodiment, the lower portion of a cross-over assembly 40 is depicted including ports 58 for the discharge of a fracturing fluid into annulus 48 and ports 62 for the discharge of a gravel packing slurry into gravel packing assembly 112. It should be noted by those skilled in the art that alternate port configurations such as ports 58 being located below ports 62 may also be used without departing from the principle of the present invention. Referring to FIGS. 6 and 7, gravel packing assembly 112 has an outer tubular 114. A portion of the side wall of outer tubular 114 is an axially extending production section 116 that includes a plurality of openings 118. Another portion of the side wall of outer tubular 114 is an axially extending nonproduction section 120 that includes one or more outlets 122. For reasons that will become apparent to those skilled in the art, the density of opening 118 within production section 116 of outer tubular 114 is much greater than the density of outlets 122 in nonproduction section 120 of outer tubular 114. Also, it should be noted by those skilled in the art that even though FIG. 6 has depicted openings 118 and outlets 112 as being circular, other shaped openings may alternatively be used without departing form the principles of the present invention. Likewise, even though FIG. 6 has depicted openings 118 as being the same size as outlets 122, openings 118 could alternatively be larger or smaller than outlets 122 without departing from the principles of the present invention. In addition, the exact number, size and shape of openings 118 are not critical to the present invention, so long as sufficient area is provided for fluid production therethrough and the integrity of outer tubular 114 is maintained.

Disposed within outer tubular 114 is an inner tubular 124. A portion of the side wall of inner tubular 124 is an axially extending production section 126 that is substantially circumferentially aligned with production section 116 of outer tubular 114. Production section 126 of inner tubular 124 has a plurality of opening 128 therethrough. Again, the exact number, size and shape of openings 128 are not critical to the present invention, so long as sufficient area is provided for fluid production and the integrity of inner tubular 124 is maintained. Another portion of the side wall of inner tubular 124 is an axially extending nonproduction section 130 that is substantially circumferentially aligned with nonproduction section 120 of outer tubular 114. Nonproduction section 130 of inner tubular 124 has no openings therethrough.

Disposed within an annulus 132 between outer tubular 114 and inner tubular 124 is an isolation member 134. Isolation member 134 includes a pair of substantially parallel, circumferentially spaced apart, axially extending members 136, 138 that radially extend between outer tubular 114 and inner tubular 124. In fact, members 136, 138 provide circumferential fluid isolation between production section 116 and nonproduction section 120 of outer tubular 114. In addition, members 136, 138 provide circumferential fluid isolation between production section 126 and nonproduction section 130 of inner tubular 124. As such, members 136, 138 define the circumferential boundary between a gravel packing slurry passageway 140, having radial boundaries defined by nonproduction section 120 of outer tubular 114 and nonproduction section 130 of inner tubular 124, and a production pathway 142, having radial boundaries defined by production section 116 of outer tubular 114 and production section 126 of inner tubular 124. Isolation member 134 also includes a pair of substantially parallel, axially spaced apart, circumferentially extending members, only member 144 being visible, that radially extend between outer tubular 114 and inner tubular 124 and that complete the isolation between gravel packing slurry passageway 140 and production pathway 142.

In operation, when apparatus 110 is in the gravel packing position, the gravel packing slurry is discharged into gravel packing assembly 112 from ports 62 of cross-over assembly 40. The slurry enters assembly 112 and travels down slurry passageway 140. Portions of the slurry exit assembly 112 through exit ports 122. The gravel from these portions of the slurry is then deposited in annulus 48. A portion of the slurry reenters assembly 112 through openings 118 in outer tubular 114. The liquid in this portion of the slurry travels through the sand control screen (not pictured) positioned within assembly 112. The gravel, however, is filtered out by the screen and deposited in production pathway 142. As exit ports 122 are spaced along the length of gravel packing assembly 112 or the numerous sections of gravel packing assemblies that are necessary for most production intervals, the entire production interval is uniformly packed even if sand bridges form between casing 34 and gravel packing assembly 112 during the gravel packing operations.

Even though FIG. 6 depicts gravel packing assembly 112 as delivering the gravel slurry into annulus 48 exclusively via exit ports 122, it should be understood by those skilled in the art that gravel packing assembly 112 may additionally have discharge ports in outer tubular 114 proximate ports 62 of cross-over assembly 40 that allow some or substantially all of the gravel slurry to be discharged directly into annulus 48. In such a configuration, if a sand bridge forms between gravel packing assembly 112 and casing 34, as the pressure within annulus 48 increases, the gravel slurry will preferentially travel through slurry passageway 140 to bypass the sand bridge. As described above, portions of the slurry exit assembly 112 through exit ports 122 such that the gravel is deposited in annulus 48 until a complete gravel pack is achieved.

As should be apparent to those skilled in the art, gravel packing assembly 112 may have a variety of configurations having, for example, additional slurry passageways such as two, four or more slurry passageways without departing from the principles of the present invention. In addition, it should be understood by those skilled in the art that use of various configurations of the gravel packing assembly in the same interval is likely and may be preferred. Specifically, it may be desirable to have a volumetric capacity within the slurry passageways that is greater toward the top, in a vertical well, or heel, in an inclined or horizontal well, of a string of consecutive gravel packing assemblies than toward the bottom or toe of the interval. This may be achieved by using gravel packing assemblies having more slurry passageways near the top or heel of the interval and less slurry passageways near the bottom or toe of the interval. This may also be achieved by using gravel packing assemblies of the present invention having wider slurry passageways near the top or heel of the interval and narrower slurry passageways near the bottom or toe of the interval.

Figure 8:
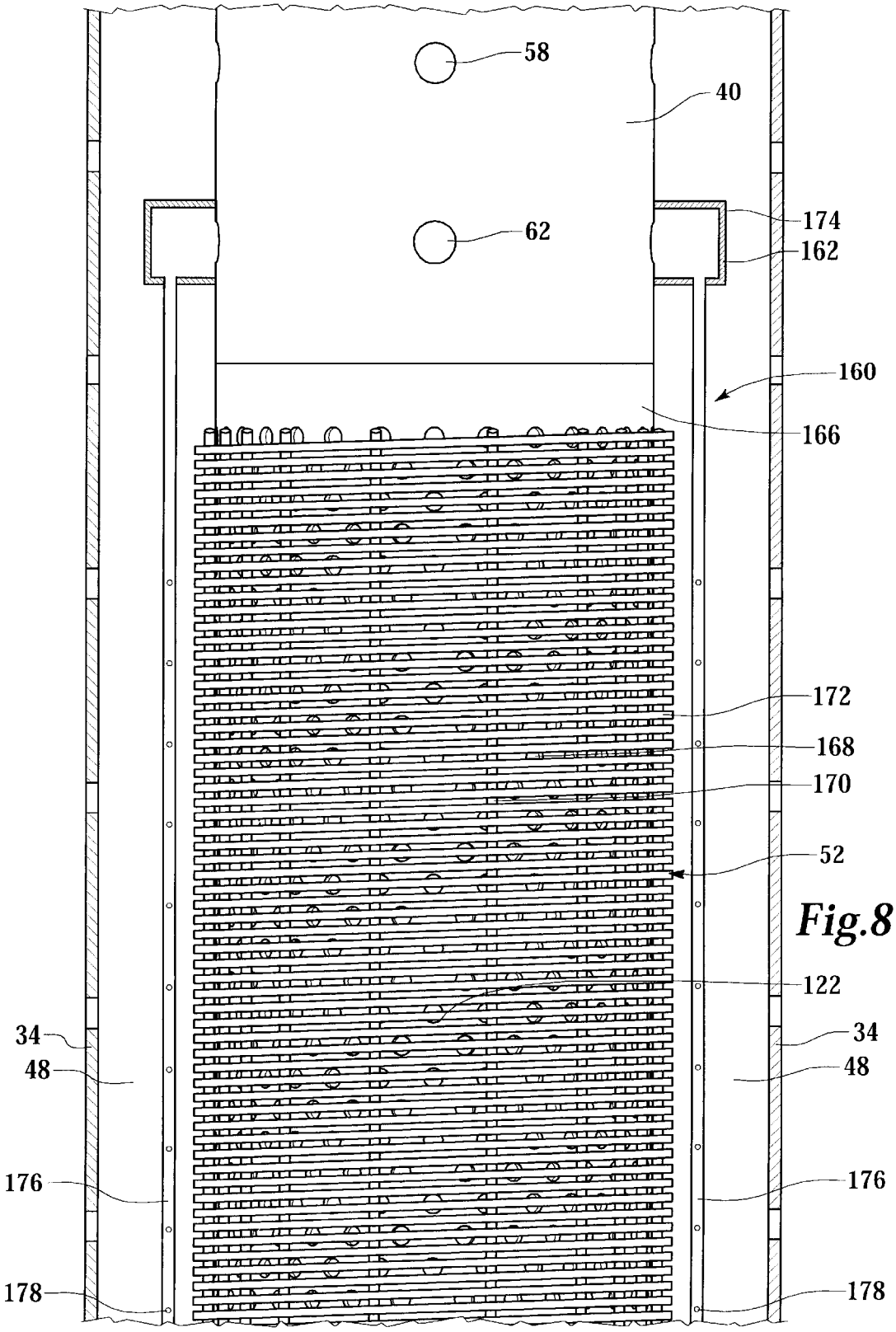
FIG. 8 is a side elevation view of a gravel packing apparatus of an apparatus for sequentially packing an interval of a wellbore of the present invention.

Referring now to FIG. 8, therein is depicted another embodiment of an apparatus for sequential packing an interval of a wellbore of the present invention that is generally designated 160. In the illustrated embodiment, the lower portion of a cross-over assembly 40 is depicted including ports 58 for the discharge of a fracturing fluid into annulus 48 and ports 62 for the discharge of a gravel packing slurry into gravel packing assembly 162. Gravel packing assembly 162 is positioned around sand control screen 52. Sand control screen 52 includes a base pipe 166 that has a plurality of openings 168 which allow the flow of production fluids into the production tubing. The exact number, size and shape of openings 168 are not critical to the present invention, so long as sufficient area is provided for fluid production and the integrity of base pipe 166 is maintained.

Spaced around base pipe 166 is a plurality of ribs 170. Ribs 170 are generally symmetrically distributed about the axis of base pipe 166. Ribs 170 are depicted as having a cylindrical cross section, however, it should be understood by one skilled in the art that ribs 170 may alternatively have a rectangular or triangular cross section or other suitable geometry. Additionally, it should be understood by one skilled in the art that the exact number of ribs 170 will be dependent upon the diameter of base pipe 166 as well as other design characteristics that are well known in the art.

Wrapped around ribs 170 is a screen wire 172. Screen wire 172 forms a plurality of turns each having a gap therebetween through which formation fluids flow. The number of turns and the gap between the turns are determined based upon the characteristics of the formation from which fluid is being produced and the size of the gravel to be used during the gravel packing operation. Together, ribs 170 and screen wire 172 may form a sand control screen jacket which is attached to base pipe 166 by welding or other suitable technique. It should be understood by those skilled in the art that while ribs 168 and screen wire 172 are depicted in FIG. 8, other type of filtration systems may alternatively be used in the present invention, including, but not limited to, placing a wire mesh over a plurality of ribs or directly on base pipe 166 or wrapping screen wire 172 directly around base pipe 166.

Gravel packing assembly 162, which is positioned around sand control screen 52, includes a manifold 174 that is in fluid communication with ports 62 of cross-over assembly 40 and a plurality of conduits 176. Conduits 176 extend along the length of sand control screen 52 or the several sections of sand control screens 52 that may be required in a production interval. Conduits 176 include a plurality of openings 178 along the length of sand control screen 52. In operation, when apparatus 160 is in the gravel packing position, the gravel packing slurry is discharged into gravel packing assembly 162 from ports 62 of cross-over assembly 40. The slurry enters assembly 162 and travels down conduits 176. Portions of the slurry exit assembly 112 through opening 178. The liquid in this portion of the slurry travels through sand control screen 52 and is returned to the surface. The gravel, however, is filtered out by sand control screen 52 and deposited in annulus 48. As openings 178 are spaced along the length of conduits 176, the entire production interval is uniformly packed even if sand bridges form between casing 34 and sand control screen 52 during the gravel packing operations.

Even though FIG. 8 depicts gravel packing assembly 162 as delivering the gravel slurry into annulus 48 exclusively via openings 178 in conduits 176, it should be understood by those skilled in the art that gravel packing assembly 162 may have discharge ports in the manifold that allow some or substantially all of the gravel slurry to be discharged directly into annulus 48. In such a configuration, if a sand bridge forms between sand control screen 52 and casing 34, as the pressure within annulus 48 increases, the gravel slurry would enter conduits 176 either at manifold 164 or through opening 178 above the sand bridge then travel down conduits 176 to a point beyond the sand bridge. As described above, portions of the gravel slurry would then exit conduits 176 via openings 178 such that a complete gravel pack can be achieved.

Also, it should be noted by those skilled in the art that even though FIGS. 2–6 and 8 have depicted exit ports 58 and 62 as being circular, other shaped openings may alternatively be used without departing form the principles of the present invention. Additionally, even though exit ports 62 have been depicted as being below exit ports 58, these exit ports could have alternate configurations such as exit ports 62 being above exit ports 58 or exit ports 62 being circumferentially spaced apart from but at the same axial position as exit ports 58. Likewise, even though the same number of exit ports 58 and exit ports 62 have been depicted, there could alternatively be a different number of exit ports 58 as compared to exit ports 62 without departing from the principles of the present invention. Similarly, even though exit ports 58 and exit ports 62 have been depicted as being the same size, exit ports 58 and exit ports 62 could alternatively be different sizes without departing from the principles of the present invention. Specifically, it is likely that there may be a greater number of exit ports 58 than exit ports 62 or that exit port 58 may be larger than exit ports 62 as exit ports 58 are intended to deliver the fracture fluids in a larger volume and at a higher flow rate than exit ports 62 will deliver the gravel packing slurry.

As should be apparent to those skilled in the art, the present invention has numerous advantages over prior art fluid delivery systems. Specifically, the apparatus for sequentially packing an interval of a wellbore of the present invention allows for the delivery of large volumes of fracture fluids at a high flow rate and at a pressure above the fracture pressure of the formation without requiring that the fracture fluids travel through a gravel packing assembly. Since a more uniform and complete gravel pack is achieved using flow rates that are lower than the flow rates used for fracturing the formation, the gravel packing assembly of the present invention is designed to deliver the gravel packing slurry at these lower flow rates and is not intended for delivering the large fluid volumes required during fracturing operation. Prior art attempts to deliver both the fracture fluids, at the high flow rates, then the gravel packing slurry, at the lower flow rate, through a gravel packing assembly have not been successful and have resulted in low quality fractures of the formation, incomplete gravel packs or both. Accordingly, the present invention overcomes this problem by allowing high volume fluid delivery of fracture fluids followed by lower volume fluid delivery of gravel packing slurries.

Figure 9:
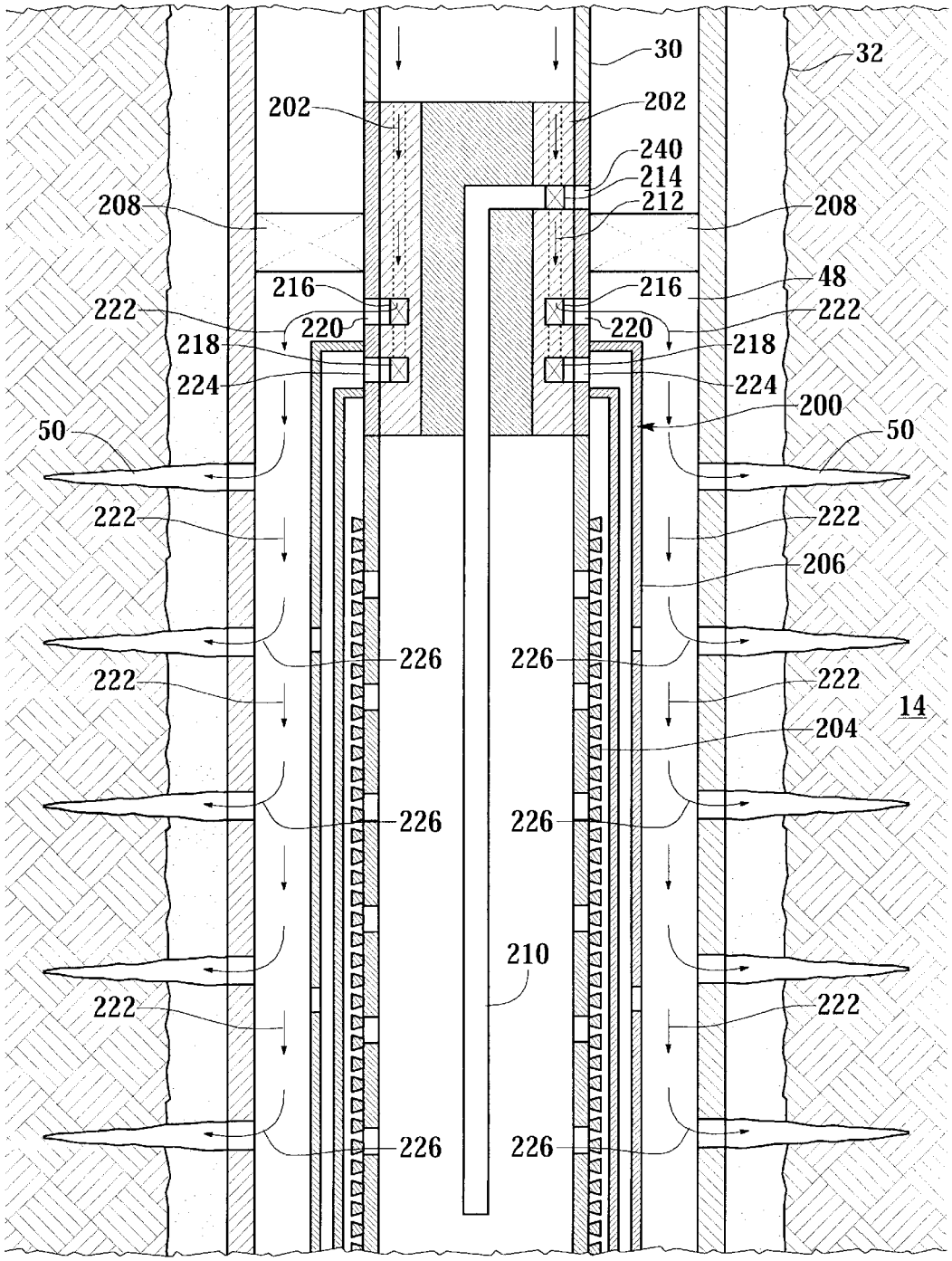
FIG. 9 is a half sectional view of an apparatus for sequentially packing an interval of a wellbore of the present invention in its fracturing position.

Referring now to FIG. 9, therein is depicted another embodiment of an apparatus for sequentially packing an interval of a wellbore that is generally designated 200. As illustrated, apparatus 200 includes cross-over assembly 202, a screen assembly 204, gravel packing assembly 206, a packer assembly 208 and a wash pipe 210. Apparatus 200 is connected to work string 30 extending from the surface, which lowers apparatus 200 into wellbore 32 until screen assembly 204 is properly positioned adjacent formation 14.

As explained above, to begin the completion process, the interval adjacent formation 14 is isolated using packers at the top and bottom of the production interval, only packer 208 being shown here. Cross-over assembly 202 is located above screen assembly 204 and partially above and below packer 208. During the fracture treatment, the fracture fluid is pumped down work string 30, into apparatus 200 and through cross-over assembly 202 along the path indicated by arrows 212. As illustrated in FIG. 9, apparatus 200 is in its fracture position wherein valve 214 is closed, valve 216 is open and valve 218 is closed. Thus, the fracture fluid passes through cross-over ports 220 below packer 208, flowing into annulus 48, along the path indicated by arrows 222. Fluids cannot return to the surface through wash pipe 210 due to closed valve 214 or a closed valve at the surface (not pictured). Likewise, the fracture fluid does not pass through cross-over port 224 due to closed valves 218. During the fracturing operation, the fracture fluid is forced at a high flow rate through perforations 50 and into formation 14 as indicated by arrows 226.

Figure 10:
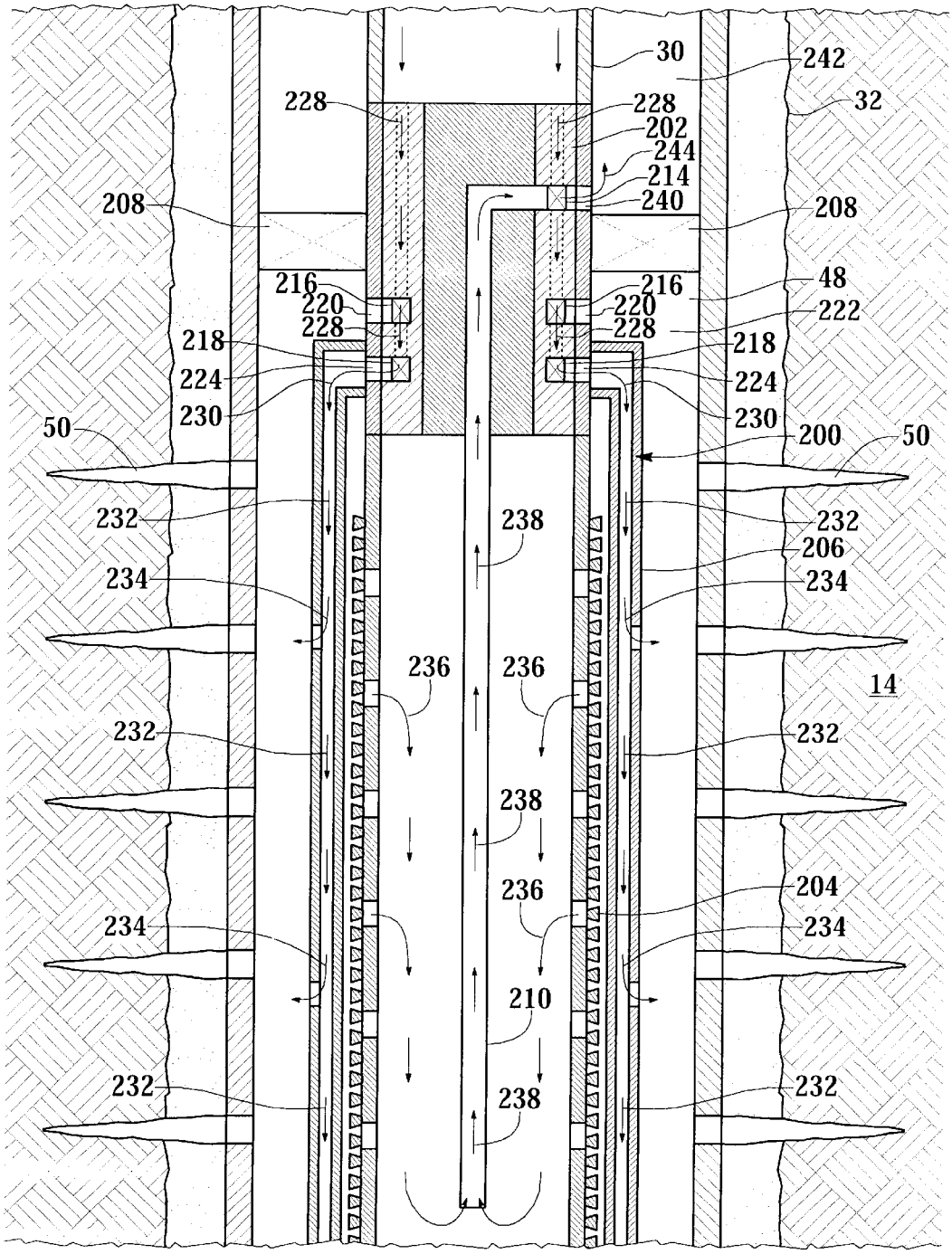
FIG. 10 is a half sectional view of an apparatus for sequentially packing an interval of a wellbore of the present invention in its gravel packing position.

Once the fracture treatment is complete, the gravel packing operation commences. Prior to introducing the gravel pack slurry, apparatus 200 is placed in the gravel packing position, as best seen in FIG. 10. In its gravel packing position, valve 214 is open, valve 216 is closed and valve 218 is open. The valves may be operated in a variety of known ways. Preferably, the valves are coupled to electronic actuators that may be operated by sending signals downhole. For example, the signals to operate the valves between their open and closed positions may be sent downhole via a direct wire, fiber optics, hydraulics, mud pulses, acoustic telemetry, electromagnetic telemetry or the like.

The gravel pack slurry is then pumped down work string 30. The slurry moves along the path indicated by arrows 228, out cross-over ports 224, as indicated by arrows 230, through gravel packing assembly 206, as indicated by arrows 232, and into annulus 48, as indicated by arrows 234. Some of the carrier fluid in the slurry leaks off through perforations 50 into formation 14 while the remainder of the fluid passes through screen 204 that is sized to prevent the gravel in the slurry from flowing therethrough. The fluid flowing back through screen 204, depicted as arrows 236, enters the inner annular area formed between screen 204 and wash pipe 210, and flows through the lower end of wash pipe 210 up the path indicated by arrows 238. The return fluids flow out through cross-over port 240 into annulus 242 above packer 208, as indicated by arrow 244, then back to the surface.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method for sequentially packing an interval of a wellbore comprising the steps of:

traversing a formation with the wellbore;

locating a sand control screen within the wellbore proximate the formation;

disposing a sequential packing apparatus proximate the sand control screen, the sequential packing apparatus having a first exit port and a second exit port;

positioning the sequential packing in a first position wherein the first exit port is open and the second exit port is closed;

pumping a first fluid into the sequential packing apparatus such that the first fluid exits the sequential packing apparatus through the first port;

operating the sequential packing apparatus from the first position to the second position wherein the first exit port is closed and the second exit port is open; and pumping a second fluid into the sequential packing apparatus such that the second fluid exits the sequential packing apparatus through the second port.

2. The method as recited in claim 1 wherein the step of pumping a first fluid into the sequential packing apparatus such that the first fluid exits the sequential packing apparatus through the first port further comprises the step of pumping the first fluid into the sequential packing apparatus such that the first fluid exits the sequential packing apparatus through the first port at a pressure above the formation fracture pressure.

3. The method as recited in claim 1 wherein the step of pumping a first fluid into the sequential packing apparatus such that the first fluid exits the sequential packing apparatus through the first port further comprises the step of pumping a fluid slurry containing propping agents into the sequential packing apparatus.

4. The method as recited in claim 1 further comprising, after the step of pumping a first fluid into the sequential packing apparatus such that the first fluid exits the sequential packing apparatus through the first port, the step of fracturing the formation.

5. The method as recited in claim 1 wherein the step of operating the sequential packing apparatus from the first position to the second position further comprising shifting a first section of the sequential packing apparatus relative to a second section of the sequential packing apparatus.

6. The method as recited in claim 1 wherein the step of operating the sequential packing apparatus from the first position to the second position further comprising operating a first valve from an open position to a closed position to prevent fluid flow through the first exit port and operating a second valve from a closed position to an open position to allow fluid flow through the second exit port.

7. The method as recited in claim 1 wherein the step of operating the sequential packing apparatus from the first position to the second position further comprising shifting a sleeve within the sequential packing apparatus.

8. The method as recited in claim 1 wherein the step of pumping a second fluid into the sequential packing apparatus such that the second fluid exits the sequential packing apparatus through the second port further comprises the step of pumping a fluid slurry containing gravel into the sequential packing apparatus and out through the second port.

9. The method as recited in claim 8 further comprising the step of terminating pumping the fluid slurry containing gravel when an annulus between the sand control screen and the wellbore is substantially completely packed with the gravel.

10. The method as recited in claim 1 wherein the step of pumping a second fluid into the sequential packing apparatus such that the second fluid exits the sequential packing apparatus through the second port further comprises the step of discharging the second fluid into a gravel packing assembly comprising a plurality of conduits extending substantially the length of the sand control screen, each conduit having a plurality of discharge ports in a sidewall section thereof.

11. The method as recited in claim 1 wherein the step of pumping a second fluid into the sequential packing apparatus such that the second fluid exits the sequential packing apparatus through the second port further comprises the step of discharging the second fluid into a gravel packing assembly substantially positioned around the sand control screen to form a first annulus between the gravel packing assembly and the wellbore, the gravel packing assembly comprising an outer tubular and an inner tubular disposed within the outer tubular forming a second annulus therebetween, the second annulus including an axially extending slurry passageway and an axially extending production pathway, the slurry passageway being in fluid isolation from the production pathway.

12. The method as recited in claim 11 wherein the step of discharging the second fluid into a gravel packing assembly further comprises discharging the second fluid into the slurry passageway such that the second fluid exits the slurry passageway through an outlet in the outer tubular, the inner tubular having no openings adjacent the slurry passageway, both the outer and inner tubulars adjacent the production pathway having a plurality of openings.

13. The method as recited in claim 11 further comprising the step of disposing an isolation member within the second annulus to define the slurry passageway and the production pathway and to prevent fluid communication therebetween.

14. The method as recited in claim 13 wherein the step of disposing an isolation member within the second annulus further comprises disposing an isolation member within the second annulus having a pair of substantially parallel, circumferentially spaced apart, axially extending members that radially extend between the outer and inner tubulars and a pair of substantially parallel, axially spaced apart, circumferentially extending members that radially extend between the outer and inner tubulars defining the slurry passageway and the production pathway and preventing fluid communication therebetween.

15. The method as recited in claim 1 wherein the first fluid and the second have the same composition.

16. A method for sequentially fracturing and gravel packing an interval of a wellbore comprising the steps of:

traversing a formation with the wellbore;

locating a sand control screen within the wellbore proximate the formation;

disposing a sequential packing apparatus proximate the sand control screen, the sequential packing apparatus having first and second exit ports;

positioning the sequential packing in a first position wherein the first exit port is open and the second exit port is closed;

pumping a fluid slurry containing propping agents into the sequential packing apparatus such that the fluid slurry containing propping agents exits through the first port at a pressure above the fracture pressure of the formation;

operating the sequential packing apparatus from the first position to the second position wherein the first exit port is closed and the second exit port is open;

pumping a fluid slurry containing gravel into the sequential packing apparatus such that the fluid slurry containing gravel exits through the second port; and discharging the fluid slurry containing gravel into a gravel packing assembly.

17. The method as recited in claim 16 further comprising, after the step of pumping a fluid slurry containing propping agents into the sequential packing apparatus such that the fluid slurry containing propping agents exits through the first port at a pressure above the fracture pressure of the formation, the step of fracturing the formation.

18. The method as recited in claim 16 wherein the step of operating the sequential packing apparatus from the first position to the second position further comprising shifting a first section of the sequential packing apparatus relative to a second section of the sequential packing apparatus.

19. The method as recited in claim 16 wherein the step of operating the sequential packing apparatus from the first position to the second position further comprising shifting a sleeve within the sequential packing apparatus.

20. The method as recited in claim 16 wherein the step of operating the sequential packing apparatus from the first position to the second position further comprising operating a first valve from an open position to a closed position to prevent fluid flow through the first exit port and operating a second valve from a closed position to an open position to allow fluid flow through the second exit port.

21. The method as recited in claim 16 further comprising the step of terminating pumping the fluid slurry containing gravel when an annulus between the sand control screen and the wellbore is substantially completely packed with the gravel.

22. The method as recited in claim 16 wherein the step of discharging the fluid slurry containing gravel into a gravel packing assembly further comprises the step of discharging the fluid slurry containing gravel into a plurality of conduits extending substantially the length of the sand control screen, each conduit having a plurality of discharge ports in a sidewall section thereof.

23. The method as recited in claim 16 wherein the step of discharging the fluid slurry containing gravel into a gravel packing assembly further comprises the step of discharging the fluid slurry containing gravel into a gravel packing assembly substantially positioned around the sand control screen to form a first annulus between the gravel packing assembly and the wellbore, the gravel packing assembly comprising an outer tubular and an inner tubular disposed within the outer tubular forming a second annulus therebetween, the second annulus including an axially extending slurry passageway and an axially extending production pathway, the slurry passageway being in fluid isolation from the production pathway.

24. The method as recited in claim 23 wherein the step of discharging the second fluid into a gravel packing assembly further comprises discharging the second fluid into the slurry passageway such that the fluid slurry containing gravel exits the slurry passageway through an outlet in the outer tubular, the inner tubular having no openings adjacent the slurry passageway, both the outer and inner tubulars adjacent the production pathway having a plurality of openings.

25. The method as recited in claim 23 further comprising the step of disposing an isolation member within the second annulus to define the slurry passageway and the production pathway and to prevent fluid communication therebetween.

26. The method as recited in claim 25 wherein the step of disposing an isolation member within the second annulus further comprises disposing an isolation member within the second annulus having a pair of substantially parallel, circumferentially spaced apart, axially extending members that radially extend between the outer and inner tubulars and a pair of substantially parallel, axially spaced apart, circumferentially extending members that radially extend between the outer and inner tubulars defining the slurry passageway and the production pathway and preventing fluid communication therebetween.

27. The method as recited in claim 16 wherein the fluid slurry containing propping agents and the fluid slurry containing gravel have the same composition.

28. An apparatus for sequentially packing an interval of a wellbore comprising:

a sand control screen;

a cross-over assembly having first and second exit ports, the cross-over assembly having a first position wherein the first exit port is open and the second exit port is closed and a second position wherein the first exit port is closed and the second exit port is open; and a gravel packing assembly having an inlet that is in fluid communication with the second exit port, the gravel packing assembly having a plurality of outlets that are located proximate the sand control screen and that extend along the gravel packing assembly substantially the length of the sand control screen.

29. The apparatus as recited in claim 28 wherein the cross-over assembly further comprises a sleeve having first and second positions, in the first position of the sleeve, the first exit port of the cross-over assembly is open and the second exit port of the cross-over assembly is closed, in the second position of the sleeve, the first exit port of the cross-over assembly is closed and the second exit port of the cross-over assembly is open.

30. The apparatus as recited in claim 28 wherein the cross-over assembly further comprises first and second valves, the first valve being in an open position and the second valve being in a closed position when the cross-over assembly is in the first position, the first valve being in a closed position and the second valve being in an open position when the cross-over assembly is in the second position.

31. The apparatus as recited in claim 28 wherein the gravel packing assembly further comprises a plurality of conduits extending substantially the length of the sand control screen, each conduit including at least one of the outlets in a sidewall section thereof.

32. The apparatus as recited in claim 28 wherein the gravel packing assembly further comprises an outer tubular and an inner tubular disposed within the outer tubular forming an annulus therebetween, the annulus including an axially extending slurry passageway and an axially extending production pathway, the slurry passageway being in fluid isolation from the production pathway.

33. The apparatus as recited in claim 32 wherein the portion of the outer tubular adjacent to the slurry passageway includes the outlets, wherein the portion of the inner tubular adjacent the slurry passageway has no openings and wherein both the outer and inner tubulars adjacent the production pathway having a plurality of openings.

34. The apparatus as recited in claim 32 further comprising an isolation member disposed within the annulus defining the slurry passageway and the production pathway and preventing fluid communication therebetween.

35. The apparatus as recited in claim 34 wherein the isolation member further comprises a pair of substantially parallel, circumferentially spaced apart, axially extending members that radially extend between the outer and inner tubulars and a pair of substantially parallel, axially spaced apart, circumferentially extending members that radially extend between the outer and inner tubulars defining the slurry passageway and the production pathway and preventing fluid communication therebetween.

36. The apparatus as recited in claim 28 further comprising a wash pipe disposed within the sand control screen to take returns, the wash pipe in fluid communication with a return port of the cross-over assembly when the cross-over assembly is in the second position.

37. An apparatus for sequentially packing an interval of a wellbore having a sand control screen disposed therein, the apparatus comprising:

a packer having a sealing surface positioned within the wellbore;

a cross-over assembly partially disposed within the packer, the cross-over assembly having first and second exit ports positioned on one side of the packer and a return port positioned on the other side of the packer, the cross-over assembly having a first position wherein the first exit port is open, the second exit port is closed and the return port is closed and a second position wherein the first exit port is closed, the second exit port is open and the return port is open;

a gravel packing assembly having an inlet that is in fluid communication with the second exit port of the cross-over assembly, the gravel packing assembly having a plurality of outlets that are located proximate the sand control screen and that extend along the gravel packing assembly substantially the length of the sand control screen; and a wash pipe disposed within the sand control screen to take returns, the wash pipe in fluid communication with the return port when the cross-over assembly is in the second position.

38. The apparatus as recited in claim 37 wherein the cross-over assembly further comprises a sleeve having first and second positions, in the first position of the sleeve, the first exit port is open while the second exit port and the return port are closed, in the second position of the sleeve, the first exit port is closed while the second exit port and the return port are open.

39. The apparatus as recited in claim 37 wherein the cross-over assembly further comprises first, second and third valves, the first valve is in an open position while the second and third valves are in a closed position when the cross-over assembly is in the first position, the first valve is in a closed position while the second and third valves are in an open position when the cross-over assembly is in the second position.

40. The apparatus as recited in claim 37 wherein the gravel packing assembly further comprises a plurality of conduits extending substantially the length of the sand control screen, each conduit including at least one of the outlets in a sidewall section thereof.

41. The apparatus as recited in claim 37 wherein the gravel packing assembly further comprises an outer tubular and an inner tubular disposed within the outer tubular forming an annulus therebetween, the annulus including an axially extending slurry passageway and an axially extending production pathway, the slurry passageway being in fluid isolation from the production pathway.

42. The apparatus as recited in claim 41 wherein the portion of the outer tubular adjacent to the slurry passageway includes the outlets, wherein the portion of the inner tubular adjacent the slurry passageway has no openings and wherein both the outer and inner tubulars adjacent the production pathway having a plurality of openings.

43. The apparatus as recited in claim 41 further comprising an isolation member disposed within the annulus defining the slurry passageway and the production pathway and preventing fluid communication therebetween.

44. The apparatus as recited in claim 43 wherein the isolation member further comprises a pair of substantially parallel, circumferentially spaced apart, axially extending members that radially extend between the outer and inner tubulars and a pair of substantially parallel, axially spaced apart, circumferentially extending members that radially extend between the outer and inner tubulars defining the slurry passageway and the production pathway and preventing fluid communication therebetween.

* * * * *